US008011161B2

(12) United States Patent
Biffis et al.

(10) Patent No.: US 8,011,161 B2
(45) Date of Patent: Sep. 6, 2011

(54) HOMES AND HOME CONSTRUCTION

(75) Inventors: Lou G. Biffis, Alliston (CA); Peter R. Biffis, Alliston (CA); Dino R. Biffis, Alliston (CA); Rocco A. Lombardi, Alliston (CA)

(73) Assignee: Cable Bridge Enterprises Limited, Alliston, Ontario (CA)

( * ) Notice: Subject to any disclaimer, the term of this patent is extended or adjusted under 35 U.S.C. 154(b) by 0 days.

(21) Appl. No.: 12/707,587

(22) Filed: Feb. 17, 2010

(65) Prior Publication Data

US 2010/0146905 A1 Jun. 17, 2010

Related U.S. Application Data

(63) Continuation of application No. 10/841,856, filed on May 7, 2004, now Pat. No. 7,690,170.

(51) Int. Cl.
*E04G 21/00* (2006.01)

(52) U.S. Cl. ..... 52/745.1; 52/79.1; 52/220.2; 52/220.3; 52/606

(58) Field of Classification Search ..... 52/125.2, 52/220.1, 220.2, 220.3, 220.5, 220.7, 220.8, 52/220.4, 220.6, 263, 745.05, 745.08, 745.09, 52/745.1, 745.13, 79.1–79.12, 606–611, 52/741.1

See application file for complete search history.

(56) References Cited

U.S. PATENT DOCUMENTS

| | | | | |
|---|---|---|---|---|
| 2,690,072 | A | | 9/1954 | Reed |
| 3,255,563 | A | | 6/1966 | Sauer |
| 3,707,165 | A | | 12/1972 | Stahl |
| 3,766,574 | A | | 10/1973 | Smid |
| 3,829,174 | A | | 8/1974 | Thomas |
| 3,888,059 | A | | 6/1975 | MacLennan et al. |
| 4,222,208 | A | | 9/1980 | Ferver |
| 4,276,730 | A | | 7/1981 | Lewis |
| 4,631,881 | A | | 12/1986 | Charman |
| 4,723,598 | A | | 2/1988 | Yoshio et al. |
| 4,835,915 | A | | 6/1989 | Nilssen |
| 4,896,469 | A | * | 1/1990 | Wright ..... 52/220.2 |
| 4,986,052 | A | | 1/1991 | Nelson |
| 5,402,618 | A | | 4/1995 | Biffis |

(Continued)

FOREIGN PATENT DOCUMENTS

GB 1433106 A 4/1976

(Continued)

OTHER PUBLICATIONS

Gilbert, William V., USPTO Communication dated Nov. 14, 2007 in relation to U.S. Appl. No. 10/841,856, filed May 7, 2004 (15 pages).

(Continued)

*Primary Examiner* — William V Gilbert

(74) *Attorney, Agent, or Firm* — Woodcock Washbrun LLP

(57) ABSTRACT

In constructing a home, a plurality of upwardly opening U-shaped channel members are installed onto a floor structure. Wall sections are then set into the plurality of U-shaped channel members. The result is that the U-channel members locate the wall sections. Each wall section may be pre-fabricated with lines for service (e.g., electrical lines or plumbing conduit) running through it. After the wall sections are set in place, the lines for service may be interconnected. Cut-outs may be provided at the sides of the wall sections to provide access to the lines for service to allow their interconnection.

18 Claims, 9 Drawing Sheets

U.S. PATENT DOCUMENTS

| | | | | |
|---|---|---|---|---|
| 5,740,858 | A * | 4/1998 | Ingram | 165/56 |
| 5,842,276 | A | 12/1998 | Asher et al. | |
| 6,253,509 | B1 | 7/2001 | Hellwig et al. | |
| 6,298,619 | B1 * | 10/2001 | Davie | 52/293.3 |
| 6,490,829 | B1 | 12/2002 | Schreiner et al. | |
| 2002/0069600 | A1 | 6/2002 | Bryant | |
| 2003/0182886 | A1 | 10/2003 | Parrish | |
| 2004/0031219 | A1 | 2/2004 | Banister | |
| 2006/0201081 | A1 | 9/2006 | Godwin | |

FOREIGN PATENT DOCUMENTS

| | | | |
|---|---|---|---|
| JP | 10102645 | A | 4/1998 |
| JP | 2000 170296 | A | 6/2000 |
| WO | WO 01/12913 | A1 | 2/2001 |
| WO | WO 02/01014 | A1 | 1/2002 |

OTHER PUBLICATIONS

Gilbert, William V., USPTO Communication dated Jul. 22, 2008 in relation to U.S. Appl. No. 10/841,856, filed May 7, 2004 (13 pages).

Gilbert, William V., USPTO Communication dated Apr. 1, 2009 in relation to U.S. Appl. No. 10/841,856, filed May 7, 2004 (12 pages).

Gilbert, William V., USPTO Communication dated Nov. 13, 2009 in relation to U.S. Appl. No. 10/841,856, filed May 7, 2004 (26 pages).

* cited by examiner

HOMES AND HOME CONSTRUCTION

CROSS-REFERENCE TO RELATED APPLICATION

This application is a continuation of U.S. application Ser. No. 10/841,856 filed May 7, 2004, now U.S. Pat. No. 7,690,170, the contents of which are incorporated herein by reference.

BACKGROUND OF THE INVENTION

This invention relates to a method for constructing a home and to home constructions.

In a traditional manner of constructing a home, a foundation is laid, then beams and floor joists are supported on the foundation. A sub-floor is installed and lines may be drawn on the sub-floor to indicate the location of interior walls. Wooden wall frames are constructed and then erected along the periphery of the floor and where indicated by the lines. Roof sections are constructed and installed at the top of the wall frames. Sheeting may then be installed on the roof sections and the roof shingled. A cladding (e.g., brick) may be installed on the outside of the outside walls. Electrical wiring and plumbing conduit may be run through the wall frames and drywall thereafter installed on the wall frames. Various finishing steps are then undertaken. This traditional manner of home building is labor intensive, is not particularly fast, and the quality of the homes are highly dependent upon the skill of the on-site labor.

U.S. Pat. No. 5,402,618 issued Apr. 4, 1995 to Biffis discloses a method of mass producing homes where a factory is located proximate a sub-division to be built. A base frame for a home is positioned on a conveyor and the home is constructed as it moves through the factory. The home may then be lifted by the base frame to be placed on a foundation in the sub-division.

While the approach in Biffis allows for faster and more uniform quality home construction, improvements to allow speedier and more uniform quality assembly would be desirable.

SUMMARY OF INVENTION

In constructing a home, a plurality of upwardly opening U-shaped channel members are installed onto a floor structure. Wall sections are then set into the plurality of U-shaped channel members. The result is that the U-channel members locate the wall sections. Each wall section may be pre-fabricated with lines for service (e.g., electrical lines or plumbing conduit) running through it. After the wall sections are set in place, any such lines for service may be interconnected. Cutouts may be provided at the sides of the wall sections to provide access to the lines for service to allow their interconnection.

In accordance with the present invention, there is provided a method of constructing a home comprising: installing a plurality of upwardly opening U-shaped channel members onto a floor structure; and setting wall sections into said plurality of U-shaped channel members such that said U-channel members locate said wall sections.

In accordance with another aspect of the present invention, there is provided a home comprising: a plurality of upwardly directed U-shaped channel members on a floor of said home outlining rooms of said home; and wall sections received in said plurality of U-shaped channel members.

In accordance with a further aspect of the present invention, there is provided a gang fastening device comprising a frame; a carriage slidably attached to opposite sides of said frame; and a plurality of gang fastener drivers adjustably mounted to said carriage.

Other features and advantages will become apparent after a review of the following description in conjunction with the drawings.

BRIEF DESCRIPTION OF THE DRAWINGS

In the figures which disclose example embodiments of the invention.

DETAILED DESCRIPTION

Figure 1:
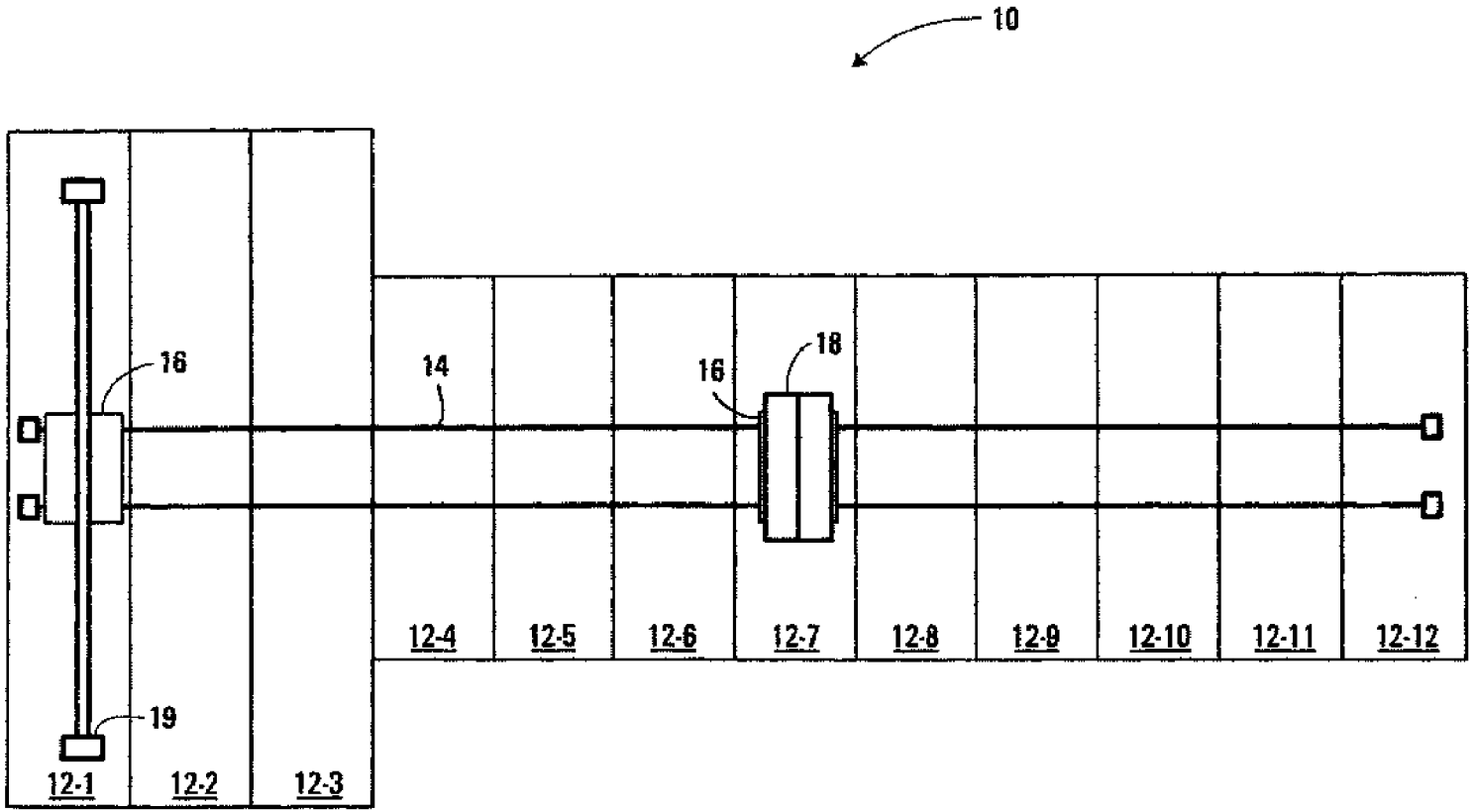
FIG. 1 is a schematic view of a factory for the assembly line production of homes.

With reference to FIG. 1, a factory 10 for the assembly line production of homes has twelve linearly arranged stations 12-1 through 12-12. A track 14 runs along the factory floor and trolleys 16 run on the track. The trolleys support the homes under construction 18 as they progress from station-to-station. The factory includes an overhead gantry crane 19.

Figure 2:
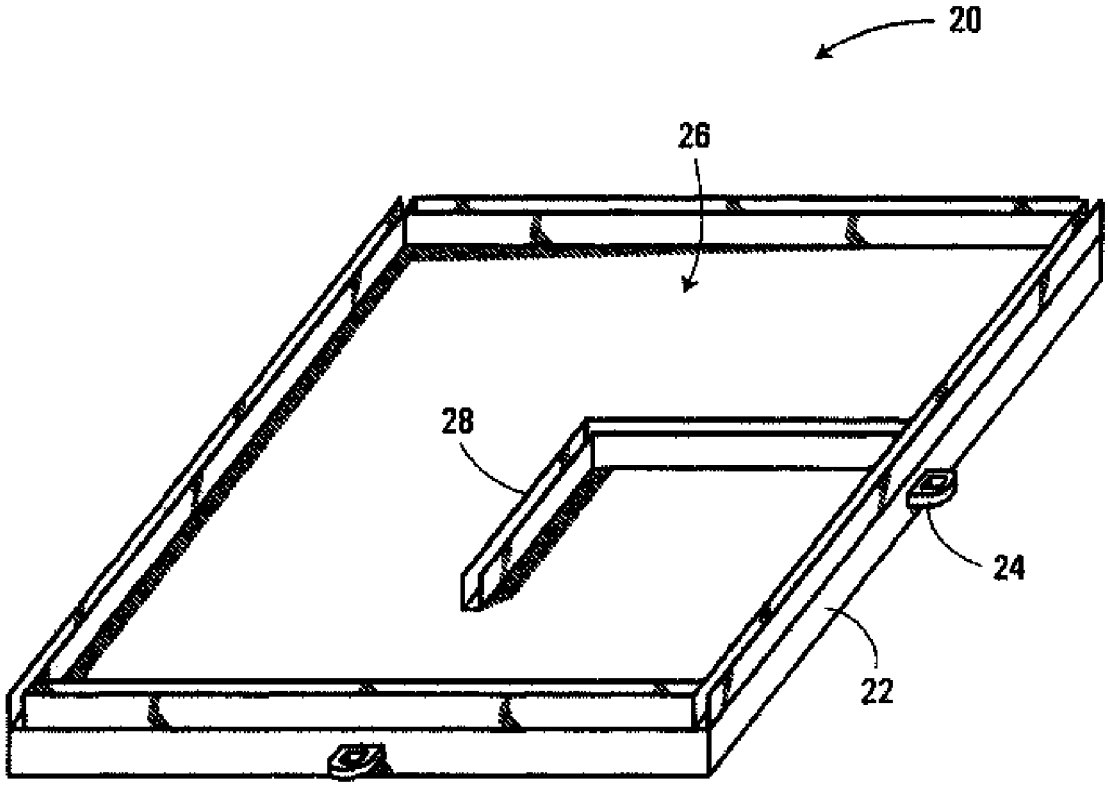
FIG. 2 is a perspective view of a base for a home.
Figure 2A:
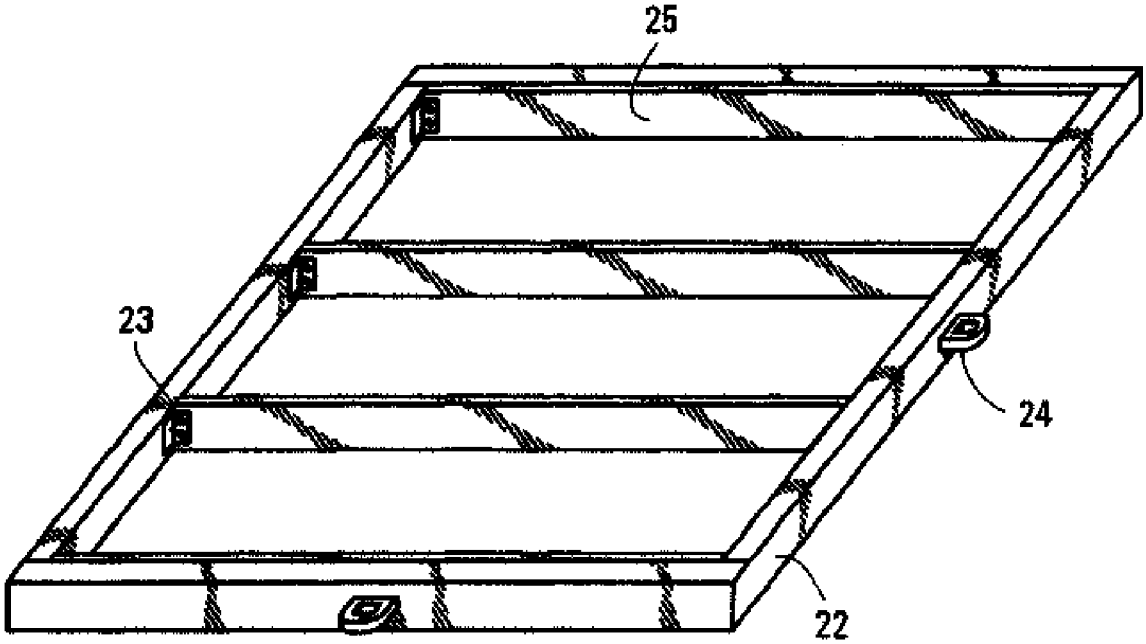
FIGS. 2A and 2B are perspective views of partially completed bases.
Figure 2B:
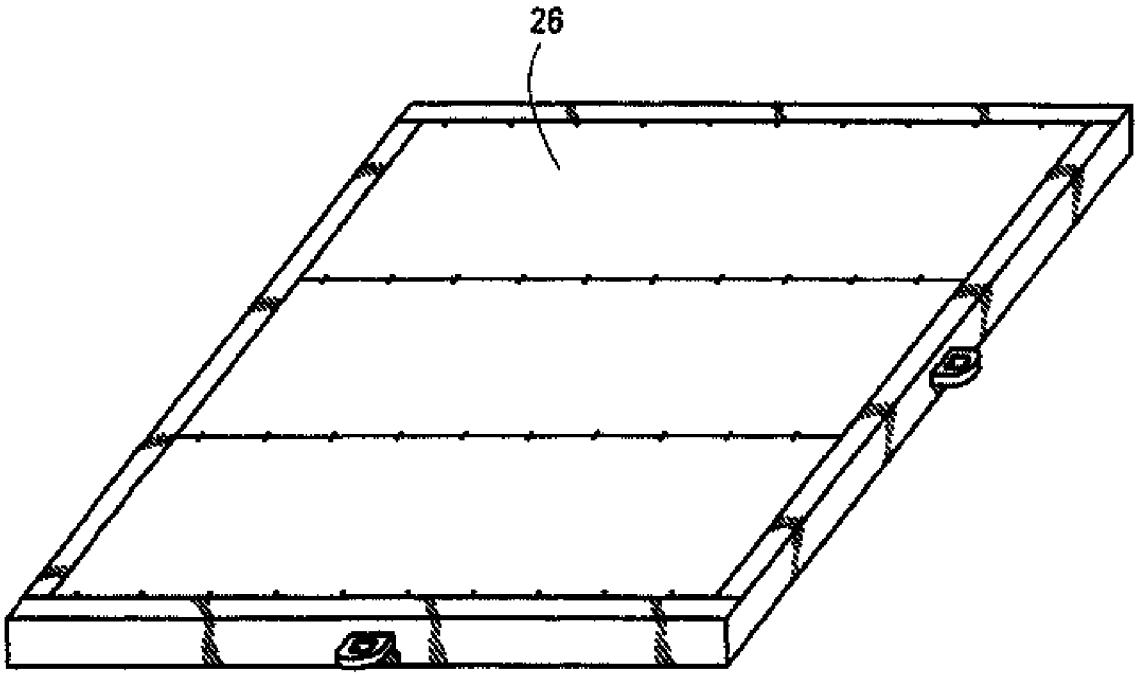

At station 12-1 parts for bases, or bases which are completed or partially completed, are received and stored. Where required, bases are constructed or completed at this station. Turning to FIG. 2, a base 20 may comprise a rectangular steel frame 22 with wooden cross-beams (not shown) and with lifting lugs 24 about periphery of the frame, all as described more fully in the aforereferenced U.S. Pat. No. 5,402,618, the contents of which are incorporated by reference herein. A sub-floor 26 is provided on the top surface of base 20. Metal U-shaped channel members 28 are mounted to sub-floor 26 along the periphery of the sub-floor and also inwardly of the periphery of the sub-floor. These U-shaped channel members define the location of the exterior and interior walls of a home that will incorporate the base.

Where bases are built up at station 12-1, with reference to FIG. 2A, the steel frame 22 may be welded together and brackets 23 welded to the frame to which the wooden cross-beams 25 are bolted. The lifting lugs 24 may also be attached to the frame 22 in any suitable manner. Next, with reference to FIG. 2B, sub-flooring 26 may be fastened to the wooden cross-beams. To complete the base, the U-shaped channel members 28 (FIG. 2) are attached.

Figure 3:
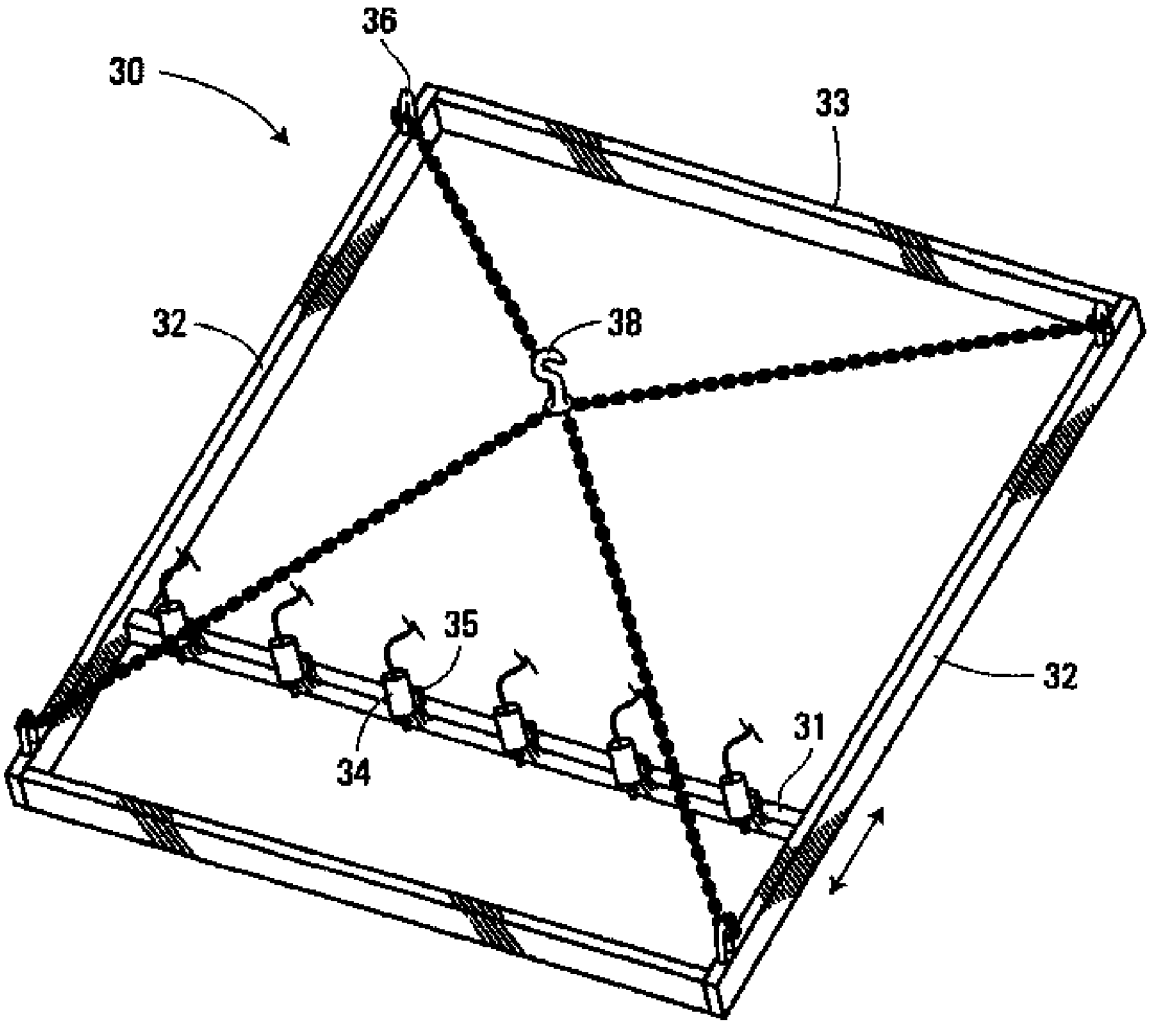
FIG. 3 is a perspective view of a gang fastening device useful in the assembly line production of homes.

Conveniently, the sub-flooring 26 may be fastened to the wooden cross-members with the gang fastening device of FIG. 3. Turning to FIG. 3, gang fastening device 30 has a carriage 31 slidably mounted to the side walls 32 of a frame 33 by, for example, frictionless bearings (not shown). A number of fastener drivers 34, such as nail guns or pneumatic screw drivers, may be mounted to the carriage by mounts 35. The mount for each driver may allow the lateral position of each driver to be adjusted, either without restriction or so that the drivers may be placed apart by a distance which is the expected distance between cross-beams 25 (FIG. 2A)—typically, either 16" or 24" apart. Where the mounts allow unrestricted lateral adjustment, the carriage may carry markings which indicate the spacing between drivers. Eyelets 36 are wired to a hook 38 to allow the gang fastening device 30 to be moved into place by the overhead gantry crane.

In use, the sub-flooring may first be laid in place, then the gang fastening device 30 lifted onto the sub-flooring. Assuming that device 30 is oriented with its sides 32 parallel to cross-beams 25 (FIG. 2A), the spacing between the drivers is then adjusted to match the spacing between the cross-beams 25. The drivers may then be loaded with fasteners and operated. In this regard, where the drivers can be loaded automatically, conveniently one control may be provided to operate all of the drivers at once.

Figure 4:
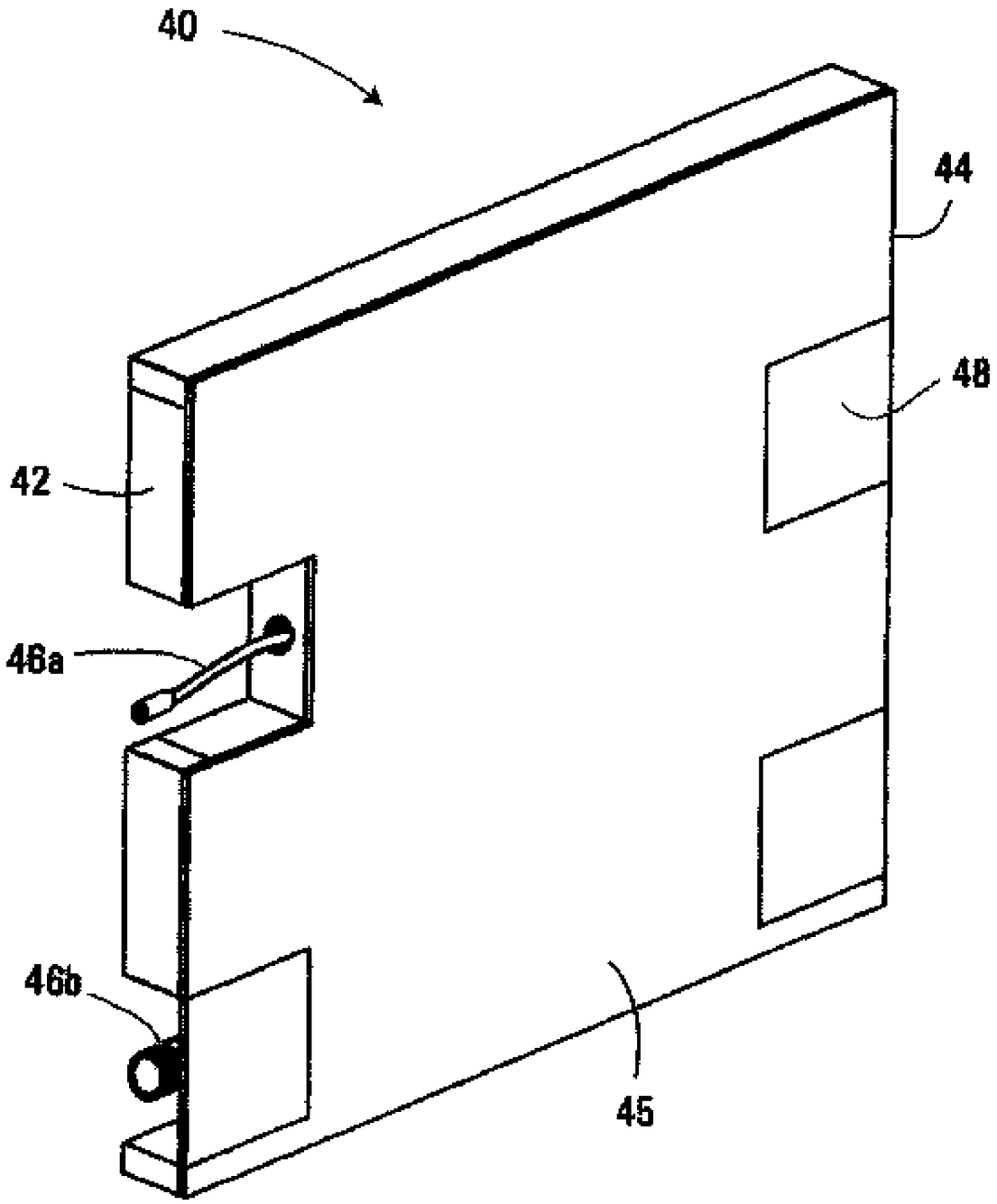
FIGS. 4 and 5 are perspective views of a wall section for a home in different stages of fabrication.

The gantry crane 19 may lift a completed (or partially completed) base 20 onto a trolley 16. After taking any necessary steps to complete the base, the trolley 16 is then moved along track 14 to station 12-2. Station 12-2 may receive parts for wall sections, or completed, or partially completed, wall sections. Where required, wall sections are constructed or completed at this station. Turning to FIG. 4, a wall section 40 comprises a wall frame 42 and may also comprise one or more sheets 45 of sheathing, such as drywall sheets. Referencing FIG. 5, which shows a wall section 40' without sheathing, along with FIG. 4, one or more lines 46*a*, 46*b* for service run along the wall frame inside the sheathing. As illustrated, line 46*a* is an electrical line and line 46*b* is plumbing conduit. As is known, the electrical line may, optionally, run through its own conduit.

Figure 5:
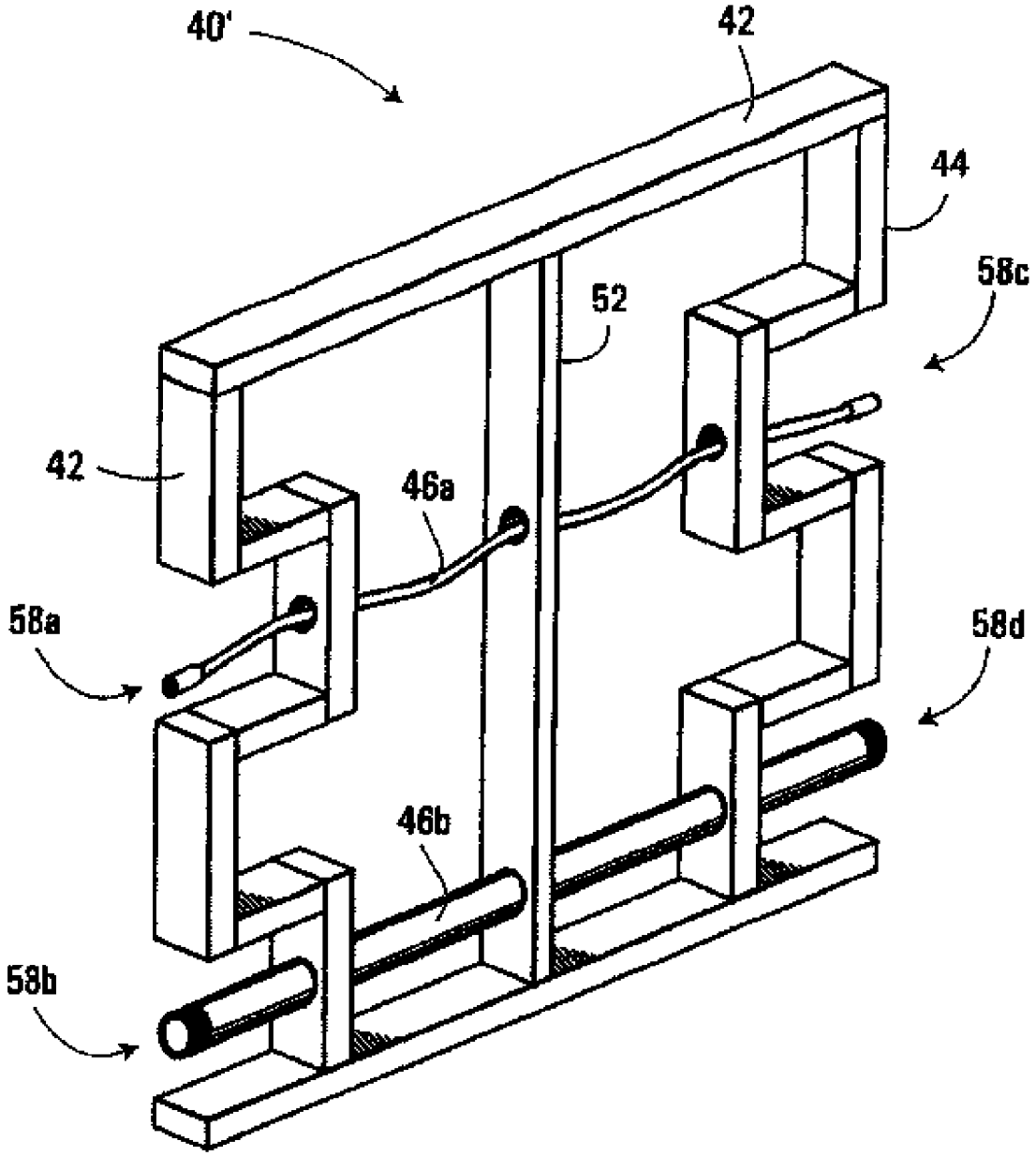

With specific reference to FIG. 5, wall frame 42 is constructed to provide cut outs (openings) 58*a*, 58*b*, 58*c*, 58*d*, with each cut out extending from one of the sides 42, 44 of the wall frame and exposing a termination of a line 46*a*, 46*b* for service. As will be described, during installation of a wall section, each cut out is covered by a cover 48 (FIG. 4). The wall frame 42 may also have a one or more studs 52 to strengthen the frame. Each stud may have openings to accommodate the lines for service.

Figure 6:
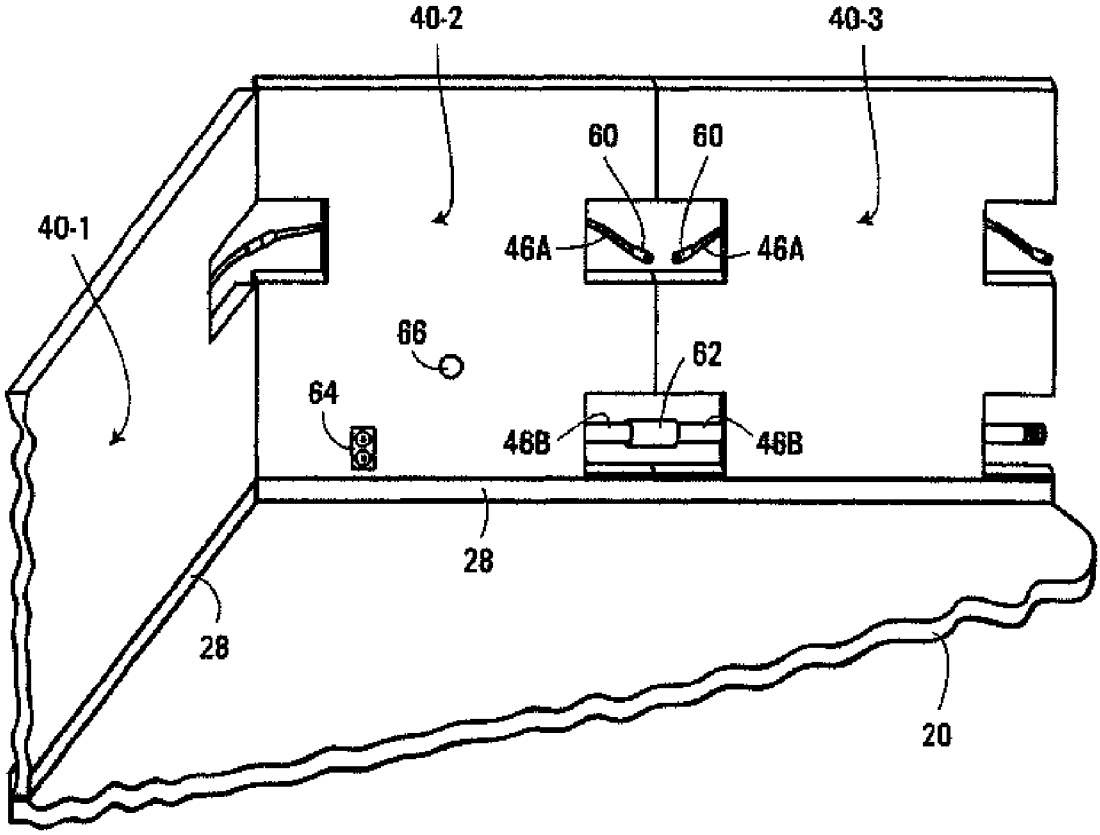
FIG. 6 is a partially broken away perspective view of a partially constructed home.
Figure 7:
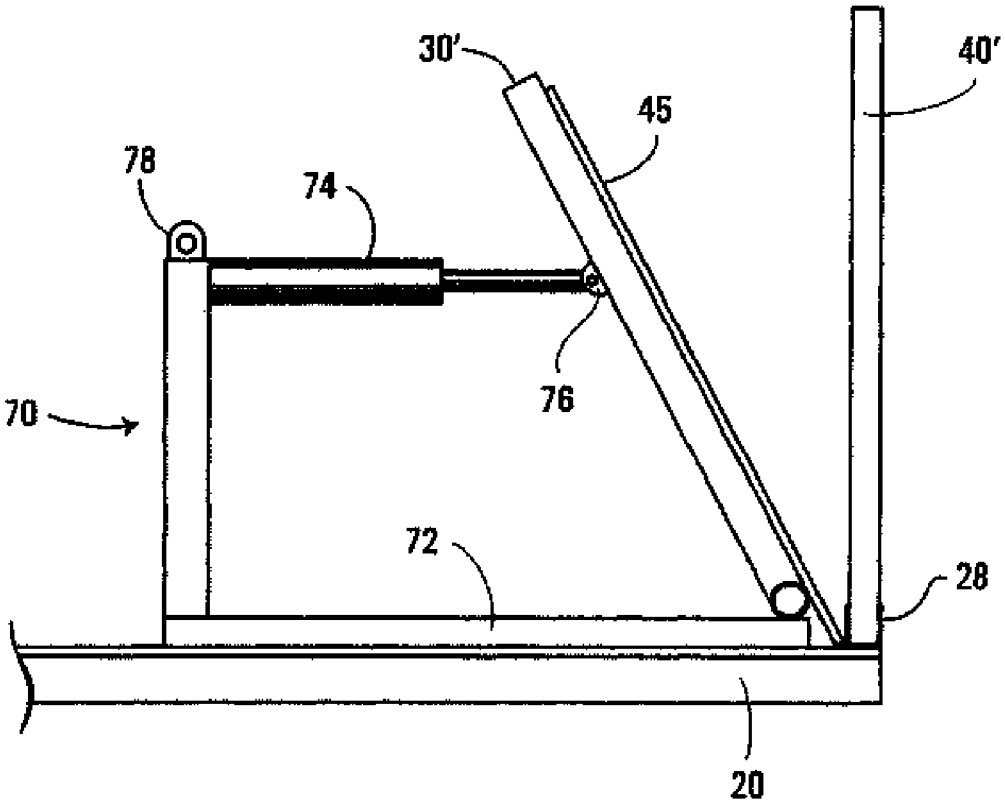
FIG. 7 is a schematic side view of an hydraulic press with a gang fastening device in place in a partially manufactured home.

With reference to FIG. 6, a completed wall section 40 (with our without sheathing) may be lifted onto a base 20 at station 12-2 and set into a U-shaped channel member 28. The U-shaped channel members therefore locate each wall section and may also provide a measure of support for each wall section. Notably, the wall sections are configured so that the adjacent terminal ends of the lines 46*a*, 46*b* of service line up. For example, side-by-side wall sections 40-2 and 40-3 each have an electrical line 46*a* and a plumbing conduit 46*b*, the terminal ends of which are aligned. These terminal ends may have complimentary terminals which allow them to be joined. For example, electrical lines 46*a* may have terminals 60 which may lock together (as illustrated in respect of the electrical lines between wall sections 40-2 and 40-1). In this regard, the electrical line 46*a* in each wall section may have some slack to allow the terminals to be pulled together. A telescoping terminal 62 is illustrated installed on one end of plumbing conduit 46*b* which may be telescoped over, and sealingly clamped to, the end of the conduit in the adjacent wall. It will be appreciated that within a wall section, a line may terminate or have a branch. For example, line 46*a* in wall section 40-2 has a branch (not shown) to feed power outlet 64. Additionally, plumbing conduit 46*b* terminates at an outlet 66 for connection to a plumbing fixture. In consequence of this, plumbing conduit 46*b* does not extend in wall section 40-2 to wall section 40-1. Further, wall section 40-1 has no plumbing conduit running through it.

Where the wall sections 40' when set in place lack sheathing. Sheathing with drywall may be quickly accomplished by using a gang fastener device similar to that of FIG. 3. Referencing FIG. 3 a fastening device 30 adapted for use in sheathing wall frames may lack eyelets 36 and the accompanying wires and hook 38. Further, the adapted fastening device may have a carriage 31 that may be latched in any given position along the sides 32 of frame 33 of the device. This may be accomplished, for example, by providing a carriage with releasable end clamps for clamping the ends of the carriage to the frame 33. Turning to FIG. 7, such an adapted gang fastening device 30' may be hinged to a base 72 of a hydraulic press 70. The hydraulic press may have a hydraulic cylinder 74 connected by a pivot 76 to fastening device 30'. An eyelet 78 of press 70 may be used to move the unit. In use, the hydraulic press with its attached fastening device 30' may be placed by overhead gantry crane 19 (FIG. 1) on a base 20 adjacent a wall frame 40' such that the device 30' cants away from the wall frame, as shown in FIG. 7. A sheet of sheathing 45 may then be rested against the device 30' and the cylinder 74 operated to press the drywall sheet against the wall frame 40'. The spacing between the drivers 34 may be adjusted so that they overlie the studs of the frame 40', the vertical position of the drivers set, and the drivers loaded and operated to simultaneously drive fasteners through the drywall and into the wall frame. This may be repeated, as desired, after changing the vertical position of the carriage 31 (FIG. 3) in order to secure the drywall in place.

Figure 8:
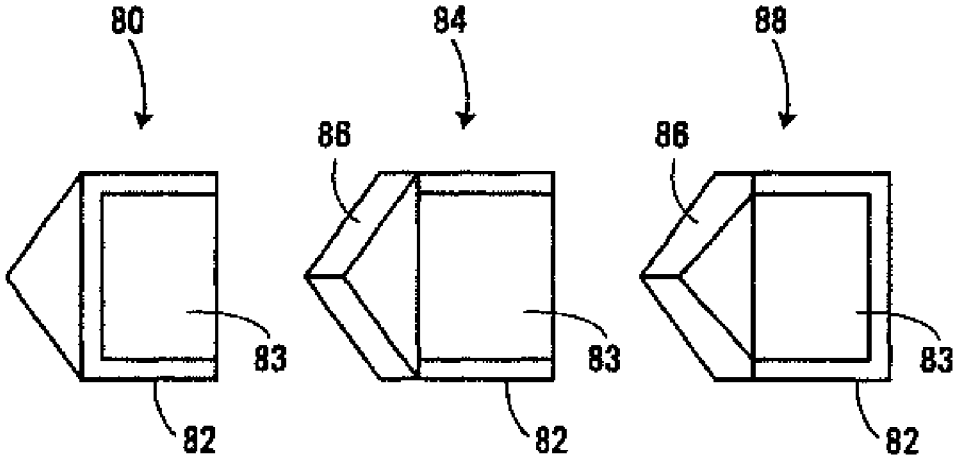
FIG. 8 is a bottom perspective view of a series of roof sections.
Figure 9:
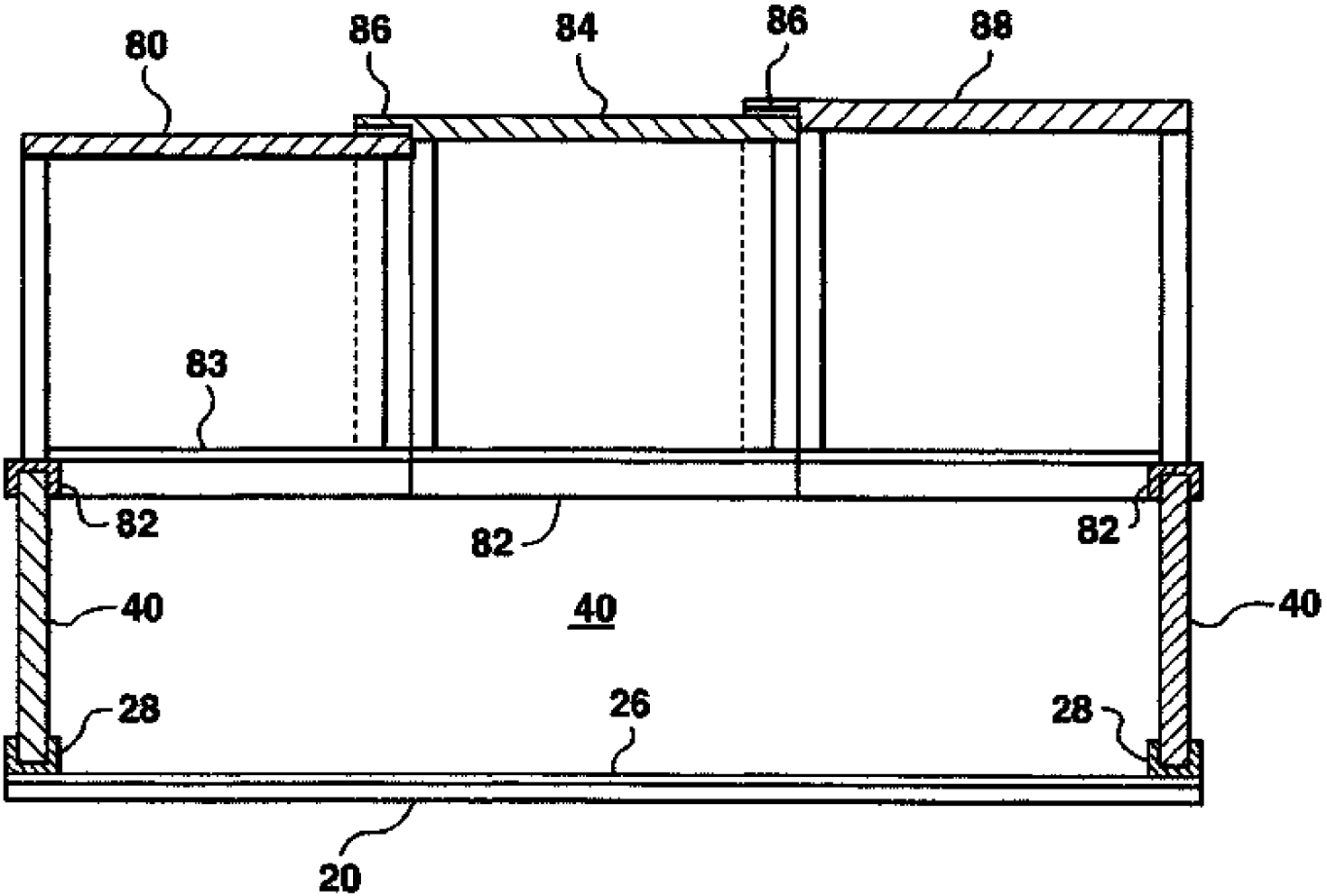
FIG. 9 is a schematic cross-sectional view of a home made in accordance with this invention.

After setting of the wall sections, the trolley moves to station 12-3 where parts for roof sections, or roof sections which are completed or partially completed, are received and stored. Where required, roof sections are constructed or completed at this station. Turning to FIG. 8 and FIG. 9, the lower lip of each roof section has a downwardly directed U-shaped channel 82 extending along the periphery of a ceiling section 83 at the base of the roof section. Additionally, all but one of the roof sections intended for a given home has a sheath 86 extending from one side. More specifically, a first end roof section 80 has a U-shaped channel 82 extending along its two ends and one of its sides. A middle roof section 84 has a U-shaped channel 82 extending along its two ends and a sheath 86 extending from one of its sides. A second end roof section 88 has a U-shaped channel 82 extending along its two ends and one of its sides and a sheath 86 extending from one of its sides.

The first end roof section 80 is hoisted in place first by the gantry crane 19 such that the tops of the outer wall sections underlying the first end roof section are received by the U-shaped members of the first end roof section. The middle roof section is next hoisted into place with its U-shaped channel members receiving the tops of the outer wall sections underlying it and such that its sheath 86 extends over a portion of the first end roof section. Finally, the second end roof section 88 is placed with its U-shaped channel members receiving the tops of the outer wall sections underlying it and such that its sheath 86 extends over a portion of the middle roof section 84. The sheaths 86 help ensure that the resulting roof will not leak. While three rectangular roof sections have been shown, obviously a different number, or sections with a different configuration, may be appropriate, depending upon the home design.

The trolley then moves to station 12-4 where the terminal ends of the lines for service in the wall sections are joined. At station 12-4 a ceiling may also be installed.

The trolley then moves to station 12-5 where the openings at the joins between the lines for service are covered with covers 46 (FIG. 4). These covers may be sealed in place with elongated caps having a T-shaped cross-section. If, on the other hand, the wall sections were not sheathed before being set in place, they may be sheathed at station 12-5. In such instance, it may not be necessary to provide cut outs 58*a*, 58*b*, 58*c*, 58*d* (FIG. 5) in the wall frames or openings through the sheathing at the cut outs.

Once manufacturing at station 12-5 is completed, the trolley is moved to station 12-6 where exterior finishes are applied. Next, at station 12-7, flooring is installed on the sub-floor. At station 12-8, interior trim is applied. At station 12-9, cabinetry is installed. At station 12-10, plumbing fixtures are connected to the terminations of the plumbing conduit (as, for example, to termination 56 seen in FIG. 5). At station 12-11, light fixtures are installed. And at station 12-12 a quality inspection is undertaken.

The home is then ready to be transferred to the subdivision and this may be accomplished as described in aforereferenced U.S. Pat. No. 5,402,618.

Modifications will be apparent to those skilled in the art and, therefore, the invention is defined in the claims.

What is claimed is:

1. A method of constructing a home comprising:

installing a plurality of upwardly opening U-shaped channel members onto a floor structure;

setting wall sections into said plurality of U-shaped such that said U-channel members locate said wall sections, wherein at least some of said wall sections have a line for a service, and wherein for each wall section having said line for a service, said line terminates at least one side of said each wall section in a terminal;

said setting comprising setting a first wall section having a first line for a service terminating at a first side in a first terminal adjacent a second wall section having a second line of service terminating at a second side in a second terminal such that said first terminal is adjacent said second terminal; and wherein said first wall section has an opening in a wall face extending from said first side, said opening being defined by a boundary of three sides, said opening exposing said first terminal of said first wall section and wherein said second wall section has an opening in a wall face extending from said second side, said opening of said second wall section exposing said second terminal of said second wall section, said first opening and said second opening being substantially aligned to define a single access point; and after said setting, utilizing said opening of said first wall section and said opening of said second wall section to connect said first terminal to said second terminal.

2. The method of claim 1 wherein each said line is an electrical line.

3. The method of claim 1 wherein each said line comprises plumbing conduit.

4. The method of claim 1 wherein said first terminal is a telescoping terminal and wherein said connecting comprises telescoping said first terminal over said second terminal.

5. The method of claim 1 wherein said line for service in said first wall section has slack and said line for service in said second wall section has slack and wherein said joining comprises pulling said first terminal and said second terminal together.

6. The method of claim 1 further comprising setting roof sections, having downwardly directed U-channel members, onto said wall sections such that a top of said of said wall sections are received by said downwardly directed U-channel members.

7. The method of claim 1 wherein said wall sections comprise wall frames covered by sheathing.

8. The method of claim 1 wherein said wall sections comprise wall frames and further comprising setting a sheet of sheathing against a wall frame and affixing said sheet to said wall frame with gang fastener drivers.

9. The method of claim 8 wherein said gang fastener drivers are mounted to a carriage, said carriage latchable at different positions along a carriage frame and wherein said affixing said sheet to said wall frame comprises positioning said carriage at a first position along said carriage frame, latching said carriage at said first position, operating said gang fastener drivers to drive fasteners into said sheathing and said wall frame; re-positioning said carriage to a second position along said carriage frame, latching said carriage at said second position, and operating said gang fastener drivers to drive additional fasteners into said sheathing and said wall frame.

10. The method of claim 8 wherein said setting and affixing comprises utilizing a hydraulic press to move said sheet into position and utilising associated gang fastener drivers loaded with fasteners to affix said sheet to said frame.

11. The method of claim 1 further comprising setting flooring sheets on floor joists and affixing said flooring sheets to said floor joists with gang fastener drivers.

12. The method of claim 1, further comprising:

setting a first roof section onto opposed first wall sections, which said opposed first wall sections are at opposite sides of said home, such that said first roof section spans said opposed first wall sections and, therefore, a width of said home;

after setting said first roof section, setting a second roof section onto opposed second wall sections, which said second wall sections are at opposite sides of said home, such that said second roof section spans said opposed second wall sections and, therefore, a width of said home, said second roof section having a sheath integrally formed therewith, said sheath extending from one side of said second roof section such that during said setting of said second roof section, said sheath is set into overlapping relation with a portion of a top surface of said first roof section to guard against leaking.

13. The method of claim 12 wherein after said setting of said second roof section, said sheath spans said opposed second wall sections.

14. The method of claim 12 wherein said first roof section has downwardly directed U-channel members and wherein said setting said first roof section onto said opposed first wall sections is such that a top of said first wall sections is received by said downwardly directed U-channel members of said first roof section.

15. The method of claim 14 wherein said second roof section has downwardly directed U-shaped channel members and wherein said setting said second roof section onto said opposed second wall sections is such that a top of said second wall sections is received by said downwardly directed U-shaped channel members of said second roof section.

16. The method of claim 12 wherein said sheath comprises a pair of rectangular panels meeting end-to-end at a peak of said second roof section.

17. A method of constructing a home comprising:

setting a sheet of sheathing against a wall frame and affixing said sheet to said wall frame with gang fastener drivers to provide a wall section;

installing a plurality of upwardly opening U-shaped channel members onto a floor structure;

said wall sections set into said plurality of U-shaped channel members such that said U-channel members locate said wall sections;

wherein said gang fastener drivers are mounted to a carriage, said carriage latchable at different positions along a carriage frame and wherein said affixing said sheet to said wall frame comprises positioning said carriage at a first position along said carriage frame, latching said carriage at said first position, operating said gang fastener drivers to drive fasteners into said sheathing and said wall frame; re-positioning said carriage to a second position along said carriage frame, latching said carriage at said second position, and operating said gang fastener drivers to drive additional fasteners into said sheathing and said wall frame.

18. The method of claim 17 wherein said setting and affixing comprises utilizing a hydraulic press to move said sheet into position and utilizing associated gang fastener drivers loaded with fasteners to affix said sheet to said frame.

* * * * *

UNITED STATES PATENT AND TRADEMARK OFFICE

CERTIFICATE OF CORRECTION

PATENT NO. : 8,011,161 B2
APPLICATION NO. : 12/707587
DATED : September 6, 2011
INVENTOR(S) : Lou G. Biffis et al.

It is certified that error appears in the above-identified patent and that said Letters Patent is hereby corrected as shown below:

Column 5,
Line 31, "said plurality of U-shaped such" should be changed to --said plurality of channel members such--;

Line 35, "said line terminates at least one side of" should be changed to --said line terminates at at least one side of--;

Signed and Sealed this
Twenty-seventh Day of March, 2012

David J. Kappos

David J. Kappos
*Director of the United States Patent and Trademark Office*